US006042942A

United States Patent [19]

Paik

[11] Patent Number: 6,042,942

[45] Date of Patent: Mar. 28, 2000

[54] SYNTHETIC YARN AND ITS MANUFACTURING PROCESS

[75] Inventor: Bo-Hyun Paik, Daegu, Rep. of Korea

[73] Assignees: Bo-Kyun Paik, Daegu, Rep. of Korea; Daesong Industrial Co., Ltd., Kyungbuk, Rep. of Korea

[21] Appl. No.: 09/121,874

[22] Filed: Jul. 24, 1998

Related U.S. Application Data

[62] Division of application No. 08/806,296, Feb. 26, 1997, Pat. No. 5,833,901.

[30] Foreign Application Priority Data

Mar. 28, 1996 [KR] Rep. of Korea ..... 96-9816

[51] Int. Cl.[7] ..... D02G 3/00

[52] U.S. Cl. ..... 428/370; 428/399

[58] Field of Search ..... 428/370, 399

[56] References Cited

U.S. PATENT DOCUMENTS

| | | | |
|---|---|---|---|
| 3,953,641 | 4/1976 | Marquis | 428/195 |
| 4,086,751 | 5/1978 | Hino et al. | 57/157 TS |
| 4,122,658 | 10/1978 | Morioka et al. | 57/140 R |
| 4,226,079 | 10/1980 | Mountney et al. | 57/288 |
| 4,324,827 | 4/1982 | Obayoshi et al. | 428/192 |
| 4,882,220 | 11/1989 | Ono et al. | 428/240 |
| 5,424,123 | 6/1995 | Gerhos et al. | 428/370 |

FOREIGN PATENT DOCUMENTS

| | | | |
|---|---|---|---|
| 246131A1 | 5/1987 | Germany | 264/211.14 |
| 45683 | 1/1970 | Japan | 264/211.14 |
| 4194017 | 7/1992 | Japan | 264/211.14 |

*Primary Examiner*—N. Edwards
*Attorney, Agent, or Firm*—Birch, Stewart, Kolasch & Birch, L.L.P.

[57] ABSTRACT

This invention relates to a manufacturing process of synthetic yarn and the produced yarn which has superior texture and brightness, and excellent color developing, hygroscopicity, and anti-static properties. A plurality of monofilaments is drawn out at an appropriate speed, dried and heated. Then a property enhancing agent containing a metallic salt, alcohol, optional solvent and optional additional functional agent, such as a hygroscopic agent, ultraviolet protecting agent, or resist agent, etc. is applied onto the surface of the filaments which are melted and flame bonded to each other. Multi-filaments are formed with spaces therebetween in which the functional agent remains inserted. The new synthetic yarn is produced after the multi-filaments are subjected to washing, drying and take-up procedures.

3 Claims, 2 Drawing Sheets

SYNTHETIC YARN AND ITS MANUFACTURING PROCESS

This application is a divisional of copending application Ser. No. 08/806,296, filed on Feb. 26, 1997, U.S. Pat. No. 5,833,901 the entire contents of which are hereby incorporated by reference.

The present invention relates to a synthetic yarn and a manufacturing process for making the synthetic yarn. The synthetic yarn has a silk-like feel, brightness, superior color developing properties, deep shade properties, hygroscopicity and anti-static properties.

BACKGROUND OF THE INVENTION

Generally, among various kinds of synthetic yarns, those which are light in weight, which are convenient for needlework, and have the ability to be dyed at a normal temperature, as well as those having superior absorptiveness and color developing properties similar to polyester, are limited in their usage to areas which do not include clothes because of inferior texture properties and lacking a silk-like feel.

Various Korean cloth type cloths are made using twisted and flame bonded acrylic filaments or made by melting filaments at 120° C. using a heat process, but a shortage of this material exists because of slow, complicated processing conditions. The flame bonding process is slow resulting in a yarn speed of 100 m/min which causes a decrease in productivity and an increase in production costs. Also, the property enhancing step during the dyeing procedure of the fabric takes about 30 minutes per meter, and deterioration in texture and color properties occur. Thin fabrics are almost impossible to process in this manner. Many consumers have experienced the problem of deterioration in quality when washing these fabrics about five times.

OBJECT AND SUMMARY OF THE INVENTION

To solve the above problems, the present invention includes the manufacture of a synthetic yarn in which several monofilaments are melted together and solidified, so as to produce multi-filaments which make up the synthetic yarn. Minute spaces are formed between the monofilaments within multi-filaments, and functional material is inserted therein so as to provide superior dyeing, hygroscopicity, and warmth properties. The silk-like feel and brightness properties allow this synthetic yarn to be used in various kinds of clothing.

To accomplish the above-mentioned objects, this invention includes drawing out a plurality of monofilaments at an appropriate tension; heating the surface of the drawn-out monofilaments of synthetic yarn at an elevated temperature; passing the monofilaments though a property enhancing agent, wherein the surfaces of the monofrilaments are partially melted together and solidified to form multi-filaments which are used for the synthetic yarn. Then conventional processes of washing, drying, and take-up to produce the synthetic yarn product are followed. According to the above-mentioned procedures, the manufacturing of a new synthetic yarn in accordance with this invention is accomplished.

The elevated temperature used to make the synthetic yarn is around 60–180°. The property enhancing agent which is applied during melting of the filament surfaces contains an optional solvent mixed with industrial alcohol and metallic salt. The property enhancing agent may include additional processing materials, such as ultraviolet protecting agents, fire proofing agents, etc., along with the solvent.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

Figure 1:
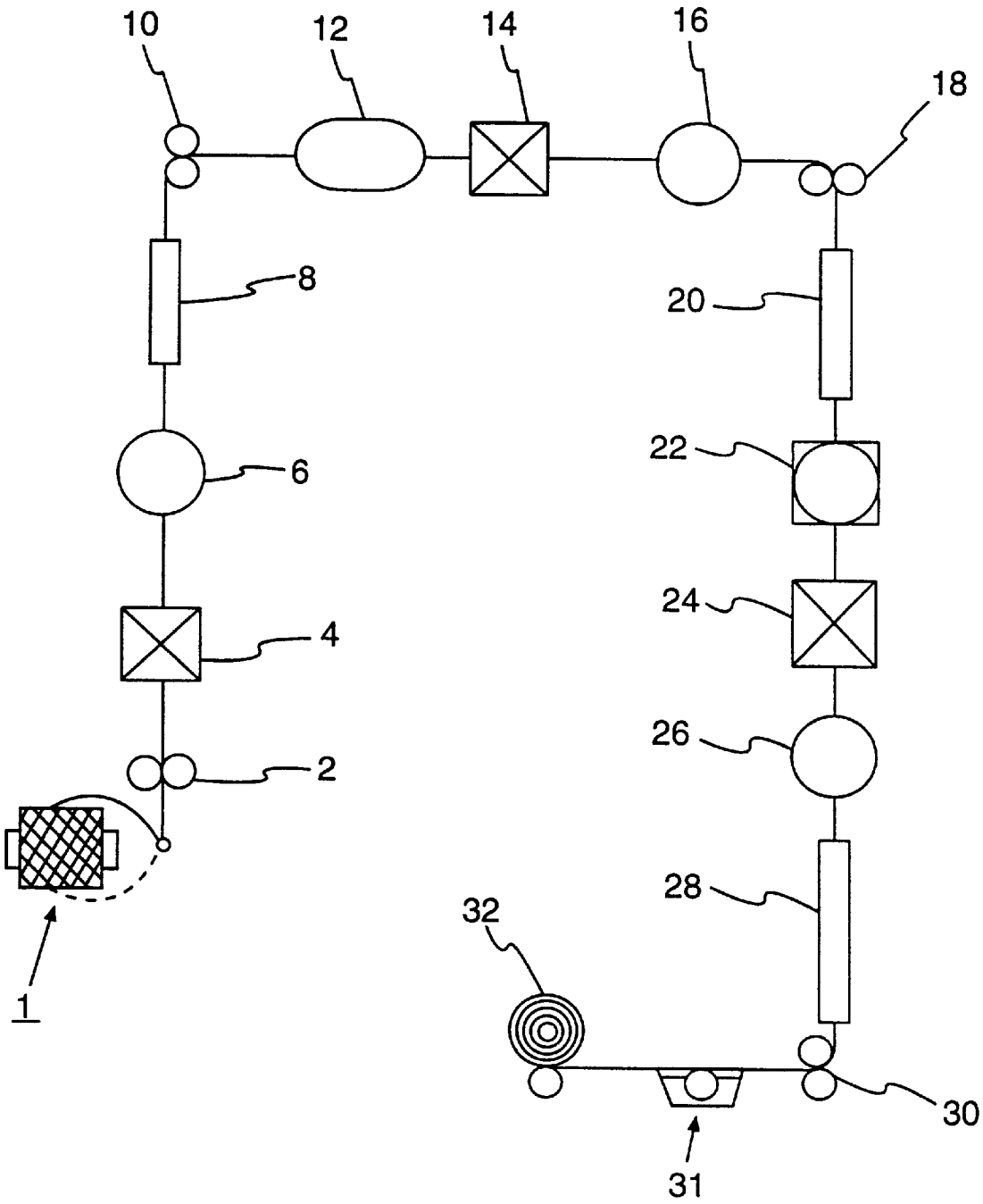
FIG. 1 is a general progress plan of the manufacturing process for this invention.
Figure 2:
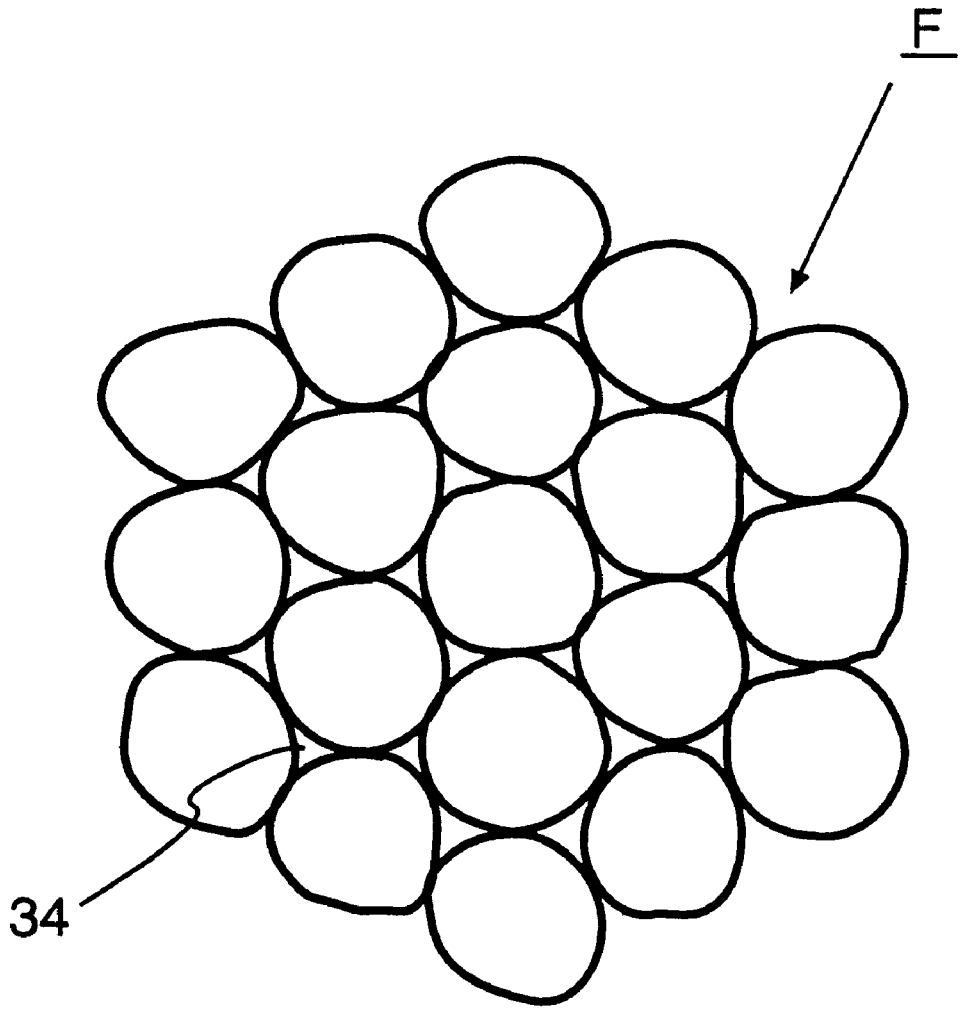
FIG. 2 is a general sectional composition plan of the new synthetic yarn of this invention.

Designations in FIGS. 1 and 2 for various aspects of this invention include: (1) synthetic yarn; (2) a first supplying roller; (4) washing tub; (6) a hot-air drying unit; (8) a heater drying unit; (10) a second supplying roller; (12) a processing unit; (14) a second washing tub; (16) a hot-air drying unit; (18) a third supplying roller; (20) a heater drying unit; (22) a property conversion unit; (24) a washing tub; (26) a hot-air drying unit; (28) a heater drying unit; (30) a drawing-out roller; (31) an oil process tub; (32) a take-up unit; and (34) space between filaments.

DETAILED DESCRIPTION OF THE INVENTION

A detailed description of a preferred embodiment of the present invention according to a general processing plan are as follows.

Under an appropriate tension, synthetic yarn (1) consisting of several filaments is drawn out through a first supplying roller (2) at a speed of about 600 m/min. The synthetic yarn is preferably a polyamide product, such as nylon. The filaments are then drawn through a first washing tub (4), so that oily matter and impurities are removed.

The washed filament (F) is then drawn through a hot-air drying unit (6) and heater drying unit (8). The temperature of the heater drying unit (8) is maintained at 60–180° to appropriately heat the filaments.

The filament (F) is then drawn through a second supply roller (10). At a processing unit (12), a property enhancing agent is applied to the surface of filament (F) and contains a metallic salt and alcohol. The metallic salt is preferably metallic salt, such as for example $ZnCl_2$, $AlCl_3$, or $PbSO_4$. The alcohol is preferably a lower alkyl alcohol, such as methyl alcohol. The temperature of the enhancing agent is about 40° C. A preferred mixture for the enhancing agent contains 15–25% by weight of metallic salt, 75–85% by weight of alcohol and an optional solvent. The enhancing agent may also contain additional functional agents, such as an ultraviolet protecting agent, a fire proofing agent, a hygroscopic agent, etc. which may be mixed with the enhancing agent at the processing unit (12).

The above-mentioned process causes the surface of a synthetic filament, such as nylon filament, to partially melt in the presence of the property enhancing agent which contains a metallic salt and alcohol, and several filaments become flame bonded to each other so as to form multi-filaments. If this condition is maintained, the melting will continue. Thus, a procedure of washing follows in order to prevent excessive melting after flame bonding. The solvent is removed by washing, and other functional agents remain in the spaces (34), for example in gel form, which cannot decompose in water. At the second washing tub (14), removal of the remaining enhancing agent on the surface of the filaments is carried out.

The filaments are then dried at a hot-air drying unit (16). The filaments (F) are subjected to further drying in a heater drying unit (20) and drawn through a third supplying roller (18) to completely dry. The multi-filaments are then treated with the property enhancing agent in a property conversion unit (22). Then, the filaments are washed in a tub (24), and completely dried in a drying unit (26) and heater drying unit (28).

Although the property enhancing agent is the same during the first and second treatments, the effect of the enhancing agent is different for each of these treatments. More specifically, the first application of the property enhancing agent is on monofilaments for flame bonding so as to form multi-filaments. The second application affects the molecular chains of the synthetic yarn which form on the external layer of the multi-filaments. The property enhancing agent caps the potential further molecular links on the surface of the multi-filaments in order to preserve the new functional properties permanently.

After drying the filaments (F) is completed, the filaments are drawn out through a drawing roller (30). Then the filaments are oil processed in a tub (31), and taken up at unit (32). Thus, the manufacture of new synthetic yarn which is the goal of this invention is completed. Between the filaments, spaces (34) exist at regular intervals. The spaced remain from the flame bonding of several filaments together as shown in FIG. 2.

Based on the inserted functional materials in the spaces (34), the synthetic yarn may have proper moisture properties as well as superior hygroscopicity, dyeing and warmth properties. If this fabric is used for clothing, the generation of static electricity can be controlled based on the inserted functional materials. Also, since several filaments are flame bonded to each other, the density can be adjusted for material used in summer clothing.

Therefore, the present invention is directed to processing of the surface of a plurality of synthetic filaments by treatment with a mixed liquid containing a metallic salt and alcohol combined with melting. Many desired effects may be achieved by employing the spaces between the filaments by inserting appropriate functional materials therein.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A synthetic yarn produced according to a process which comprises:

drawing out a plurality of monofilaments of synthetic yarn;

heating and drying the monofilaments at an elevated temperature of about 60–180° C.;

applying a property enhancing agent to surfaces of the monofilaments while maintaining the elevated temperature, said agent containing 15–25% by weight of a salt, 75–85% by weight of an alcohol and a solvent;

at least partially melting the surfaces of the monofilaments so that the surfaces of the monofilaments bond together to form multi-filaments;

washing the multi-filaments; and combining the multi-filaments together to produce the synthetic yarn.

2. The synthetic yarn of claim 1, wherein the property enhancing agent further comprises a functional agent selected from the group consisting of an ultraviolet protecting agent, a fire proofing agent, a hygroscopic agent and a mixture thereof.

3. The synthetic yarn of claim 1, wherein after washing the multi-filaments, the washed multi-filaments are dried, treated with the property enhancing agent again, washed again and then combined together to produce synthetic yarn.

* * * * *